US012600443B2

(12) United States Patent
Ma et al.

(10) Patent No.: US 12,600,443 B2
(45) Date of Patent: Apr. 14, 2026

(54) FLOATING UNIT WITH UNDER KEEL TANK

(71) Applicant: Chevron U.S.A. Inc., San Ramon, CA (US)

(72) Inventors: Wei Ma, Houston, TX (US); Fei Yang, Houston, TX (US); Jack Darryl Payne, Spring, TX (US); Peter Leitch, Houston, TX (US); Renjian Roger Lu, Houston, TX (US); Tao Wang, Katy, TX (US); Jon Husby, Houston, TX (US); Erling Storaune, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 429 days.

(21) Appl. No.: 18/246,210

(22) PCT Filed: Sep. 30, 2021

(86) PCT No.: PCT/US2021/052861

§ 371 (c)(1),
(2) Date: Mar. 22, 2023

(87) PCT Pub. No.: WO2022/072623

PCT Pub. Date: Apr. 7, 2022

(65) Prior Publication Data

US 2023/0356814 A1 Nov. 9, 2023

Related U.S. Application Data

(60) Provisional application No. 63/085,816, filed on Sep. 30, 2020.

(51) Int. Cl.
*B63B 35/44* (2006.01)
*B63B 1/10* (2006.01)
(Continued)

(52) U.S. Cl.
CPC ..... *B63B 35/44* (2013.01); *B63B 1/107* (2013.01); *B63B 43/14* (2013.01); *B63B 2001/128* (2013.01)

(58) Field of Classification Search
CPC ..... B63B 35/44; B63B 1/107; B63B 43/14; B63B 2001/128
See application file for complete search history.

(56) References Cited

U.S. PATENT DOCUMENTS 4,350,014 A * 9/1982 Sanchez ..... B63B 35/44 405/195.1
6,761,124 B1 * 7/2004 Srinivasan ..... B63B 1/107 405/195.1

(Continued)

OTHER PUBLICATIONS

PCT International Search Report and Written Opinion, mailed on Feb. 11, 2022, issued in International Application No. PCT/US2021/052861, filed on Sep. 30, 2021, 13 pages.

(Continued)

*Primary Examiner* — S. Joseph Morano
*Assistant Examiner* — Jovon E Hayes
(74) *Attorney, Agent, or Firm* — Avery L. Cate

(57) ABSTRACT

A tank is secured under the keel of a floating structure for offshore energy development. The tank is filled with ballast material that supplements or replaces the ballast already present on the floating structure, thereby gaining larger topsides payload capacity for the floating structure or increasing stability and motion performance of the floating structure.

20 Claims, 10 Drawing Sheets

(51) Int. Cl.
*B63B 43/14* (2006.01)
*B63B 1/12* (2006.01)

(56) References Cited

U.S. PATENT DOCUMENTS

| | | | | |
|---|---|---|---|---|
| 6,899,492 | B1 * | 5/2005 | Srinivasan | B63B 3/36 405/203 |
| 8,764,346 | B1 * | 7/2014 | Srinivasan | B63B 21/502 405/223.1 |
| 9,022,693 | B1 * | 5/2015 | Menard | B63B 35/44 405/223.1 |
| 9,476,410 | B2 * | 10/2016 | Srinivasan | F03G 7/05 |
| 10,224,699 | B2 * | 3/2019 | Leber | H01F 27/02 |
| 2009/0126616 | A1 * | 5/2009 | Srinivasan | B63B 35/4413 114/264 |
| 2009/0205554 | A1 * | 8/2009 | Srinivasan | B63B 39/00 114/264 |
| 2017/0267447 | A1 * | 9/2017 | Schramm | B65D 88/06 |

OTHER PUBLICATIONS

EP Extended European Search Report mailed on Jan. 24, 2025 issued in Application No. 21876470.2, filed on Mar. 27, 2023, 15 pages.

* cited by examiner

FLOATING UNIT WITH UNDER KEEL TANK

FIELD

The present disclosure relates to floating structures, such as semi-submersible platforms used for offshore energy development of brown and green fields.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Offshore floating platforms are designed to support a topside structure where a payload (e.g., oil and gas production and processing equipment) is specified. The stability and motion performance of these platforms in harsh environments dictate how much payload a given platform can carry. Generally, design margins for the stability and motion performance of such platforms are set to account for payload growth and changing metocean conditions. However, over time, these design margins become exhausted as more equipment is added and metocean conditions continue to change. At this point, further payload growth typically requires physical modifications to the platform, which are made onshore.

For example, for a column-stabilized platform, the addition of blisters or sponsons is a possible solution to increase payload while minimizing changes to the hull geometry. Blisters and/or sponsons are surface piercing watertight buoyant structures added to columns of a platform to increase buoyancy and/or waterplane area. Blisters are built directly on the outer shells of columns, whereas sponsons are attached to the columns through supporting structures. The addition of blisters or sponsons to an existing platform is typically performed in a dry dock facility.

For a mobile offshore drilling unit (MODU), a sub class of column stabilized platforms, dry docking every five years is typically a class requirement. For MODUs, the addition of blisters or sponsons can be timed to align with a planned dry docking. Production platforms, on the other hand, are not typically dry docked as this would require well shut-in and all mooring lines and risers to be disconnected and laid down for later reconnection. It is now recognized that it would be beneficial to have a way to increase the payload capacity and/or stability of a production platform (e.g., a floating unit) in a manner that does not significantly interrupt operations.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure include a floating structure (e.g., a semi-submersible platform) with under keel ballast in an under keel tank (UKT) or under keel tanks (UKTs). The under keel tank can be used on an existing facility when additional topsides payload is needed and/or more stability is required. Further, the under keel tank can be used for transportation, installation, or decommissioning operations for offshore facilities.

In accordance with the present disclosure, the under keel tank is located at an elevation below the keel. The water ballast inside the pontoon or column may be partially or completely replaced by the new ballast tanks (the new under keel tanks) and materials therein. Moving the ballast of the structure in this manner allows the vertical center of gravity of the structure to be lowered. By introducing ballast under the keel, the overall platform stability will be improved against overturning, so that the topsides payload can be increased, and the facility can take more severe heeling moment from wind loads. Topsides capacity expansion may be realized, for example, for existing semi-submersible platforms (brown fields), newly built semi-submersible platforms (green fields), or drilling platforms.

Following the principles of the present disclosure, a floating structure with under keel ballast in a tank or tanks secured under the keel, can be extended to tension leg platforms (TLP), single column structure, buoyant hull (Spar), floating production, storage and offloading structure (FPSO), floating wind turbine, or extended for other structures in general to increase payload capacity and/or stability in a manner that does not interrupt operations.

In an embodiment, a semi-submersible floating structure for offshore energy development includes: a pontoon; a column or a plural of columns extending from the pontoon to a deck; an under keel tank (or a plural of tanks) secured under the pontoon, and filled with air, water, or solid material, or any combination thereof, as ballast. The structure also includes one or more vertical structures vertically supporting the under keel tank relative to the pontoon and connected to one or more support structures on the pontoon; and one or more lateral restraints restraining resisting lateral movement of the under keel tank relative to the pontoon.

In another embodiment, a method of increasing payload capacity and/or stability of a floating structure for offshore energy development includes securing an under keel tank under a keel of the floating structure. The under keel tank is filled with air, water, or solid material, or any combination thereof, as ballast. The ballast of the under keel tank supplements or replaces a ballast of the floating structure, thereby lowering the vertical center of gravity of the floating structure and increasing the payload capacity and/or stability of the floating structure.

In another embodiment, a tension leg platform (TLP) with under keel ballast includes: a single or a plurality of ballast tanks located under the keel of the TLP. The under keel tank is subdivided into compartments or remains one compartment, and filled with water, and or solid (fixed) material as ballast, and or air. The under keel tank is transported to field, lowered and pulled in towards the keel, and securely installed in-place to the floating structure with no or little offshore welding. The under keel tank is vertically supported off the structures of the pontoon by truss structures, tendons, rods, or wires, connected mechanically or welded. The under keel tank is laterally restrained with support structures, friction pads and or stopper brackets.

In another embodiment, a single column floating structure with under keel ballast includes: a single or a plurality of ballast tanks located under the keel of the column. The under keel tank is subdivided into compartments or remains one compartment, and is filled with water, and or solid (fixed) material as ballast, and or air. The under keel tank is transported to field, lowered and pulled in towards the keel, and securely installed in-place to the single column floating structure with no or little offshore welding. The under keel tank is vertically supported off the structures of the lower column by truss structures, tendons, rods, or wires, connected mechanically or welded. The under keel tank is laterally restrained with support structures, friction pads and or stopper brackets.

In another embodiment, a buoyant hull (classic or truss Spar) with under keel ballast includes: a single or a plurality of ballast tanks located under the keel of the buoyant hull. The under keel tank is subdivided into compartments or remains one compartment, and filled with water, and or solid (fixed) material as ballast, and or air. The under keel tank is transported to field, lowered and pulled in towards the keel, and securely installed in-place to the soft tank with no or little offshore welding. The under keel tank is vertically supported off the structures of the lower hull by truss structures, or tendons, or rods, or wires, connected mechanically or welded. The under keel tank is laterally restrained with support structures, friction pads and or stopper brackets.

In another embodiment, a floating production, storage and offloading structure (ship shaped or round shaped FPSO) includes: a single or a plurality of ballast tanks located under the keel of the structure. The under keel tank is subdivided into compartments or remains one compartment, and is filled with water, and or solid (fixed) material as ballast, and or air. The under keel tank is transported to field, lowered and pulled in towards the keel, and securely installed in-place to the structure with no or little offshore welding. The under keel tank is vertically supported off the structures of the lower hull by truss structures, or tendons, or rods, or wires, connected mechanically or welded. The under keel tank is laterally restrained with support structures, friction pads and or stopper brackets.

In another embodiment, an under keel tank is configured to be installed under the keel of a floating structure for offshore energy development, and includes one or more compartments capable of being ballasted so as to allow the under keel tank to have sufficient ballast to expand a payload capacity of the floating structure, or to provide additional stability for the floating structure. The tank also includes one or more structures attached to the one or more compartments configured to allow the tank to be secured under the keel of the floating structure.

BRIEF DESCRIPTION OF THE DRAWINGS

These and other objects, features and advantages of the present invention will become better understood with reference to the following description, appended claims and accompanying drawings. The drawings are not considered limiting of the scope of the appended claims. Reference numerals designate like or corresponding, but not necessarily identical, elements. The drawings illustrate only example embodiments. The elements and features shown in the drawings are not necessarily to scale, but emphasis being placed upon clearly illustrating the principles of the example embodiments. Additionally, certain dimensions or positionings may be exaggerated to help visually convey such principles.

DETAILED DESCRIPTION

Figure 1:
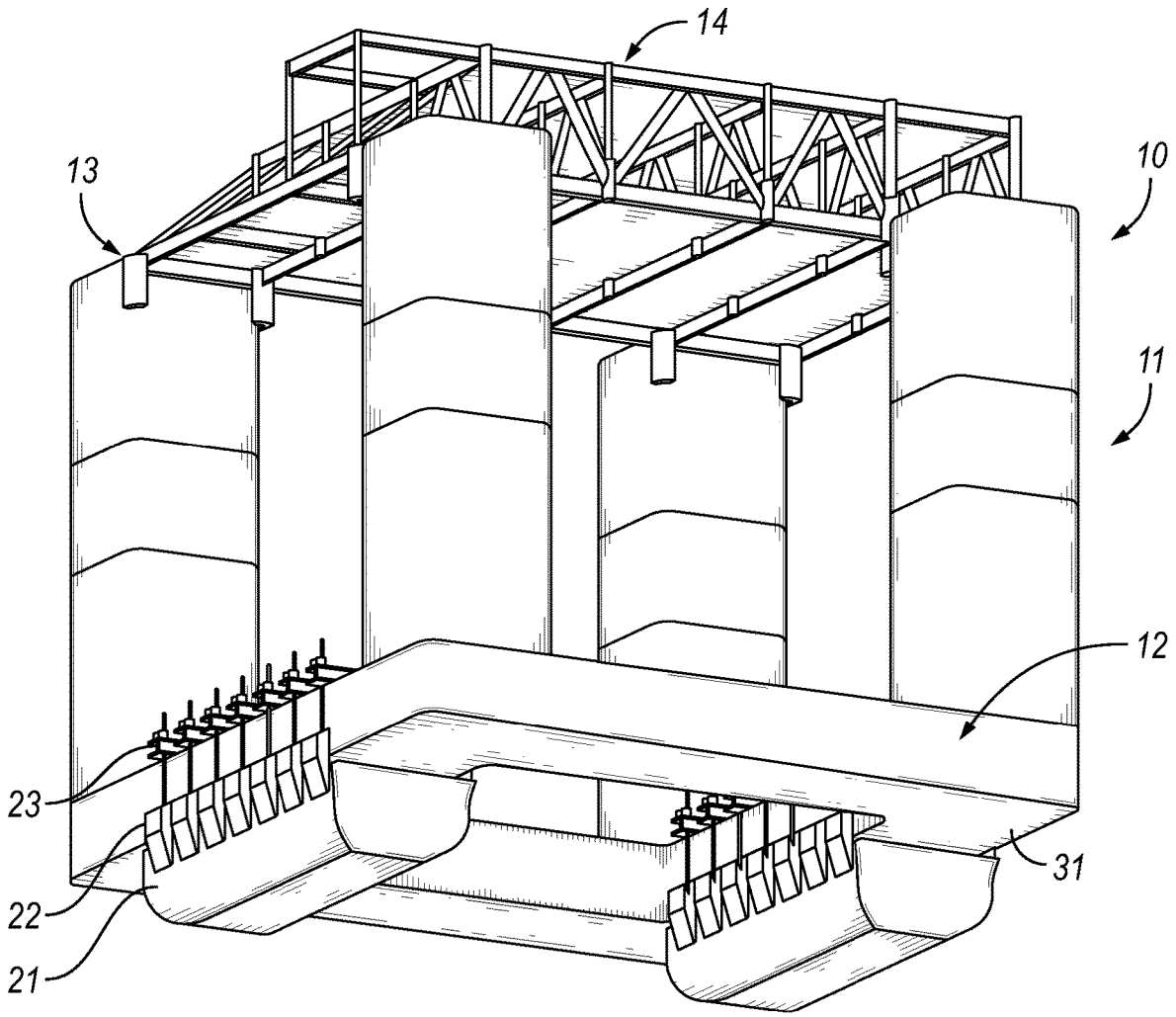
FIG. 1 and FIG. 2 are perspective views of an embodiment of a semi-submersible structure with under keel tanks.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As set forth above, it is now recognized that it would be beneficial to have a way to increase the payload capacity and/or stability of a platform (e.g., a production platform), for instance in a manner that does not interrupt production operations for a significant amount of time. In accordance with embodiments of this disclosure, a tank (e.g., a ballast tank) may be incorporated under the keel (e.g., under a pontoon) of a floating structure to partially or completely replace ballast inside a pontoon or column, and/or to add additional ballast. By way of non-limiting example, a technical effect of adding or moving ballast mass in this manner may result in lowering the vertical center of gravity of the floating structure, thereby increasing the payload capacity and/or the stability of the structure.

Embodiments of this disclosure may be applied to a variety of floating structures and may have a number of benefits that are not discussed herein. Indeed, the present disclosure is not necessarily limited to increasing payload and/or enhancing stability of a floating structure, and there may be other technical effects produced by the disclosed embodiments that solve other technical problems. By way of non-limiting example, the present embodiments may be used for transportation, installation, or decommissioning operations for offshore facilities. Further, while several embodiments of this disclosure are presented in the context of incorporating a ballast tank under the pontoon of a semi-submersible floating structure, the ballast tank may, in other embodiments, be incorporated additionally or alternatively under a column or other structure of any type of floating structure used for energy development. Examples of other structures include tension leg platforms (TLP), single column structure, buoyant hull (Spar), floating production, storage and offloading structure (FPSO), floating wind turbine structures, and so on.

Using the under keel tank approaches of the present disclosure may increase the buoyancy, stability and performance of a column-stabilized semi-submersible platform. In certain embodiments, this is done through the addition of the under keel tanks (UKTs). These UKTs, located directly underneath existing pontoons, can be either positively buoyant (void) or negatively buoyant (flooded or filled with ballast material) depending on the particular application.

In certain embodiments, the UKTs are connected to the pontoons through a structural frame requiring no or minimal underwater welding. A fixed and/or variable ballast under keel tank can be used to increase the payload capacity if stability and motion performance are limiting factors. Most floating structures such as semi-submersible platforms carry a large amount of ballast water to achieve target stability and motion performance. Replacing this ballast water with heavier fixed and/or variable ballast under the pontoons significantly reduces the vertical center of gravity (VCG) of the platform. Following the principles of the present disclosure, a floating structure with an under-keel tank can be applied to tension leg platforms (TLP), spars, FPSOs, floating wind turbines, and other such structures.

Figure 2:
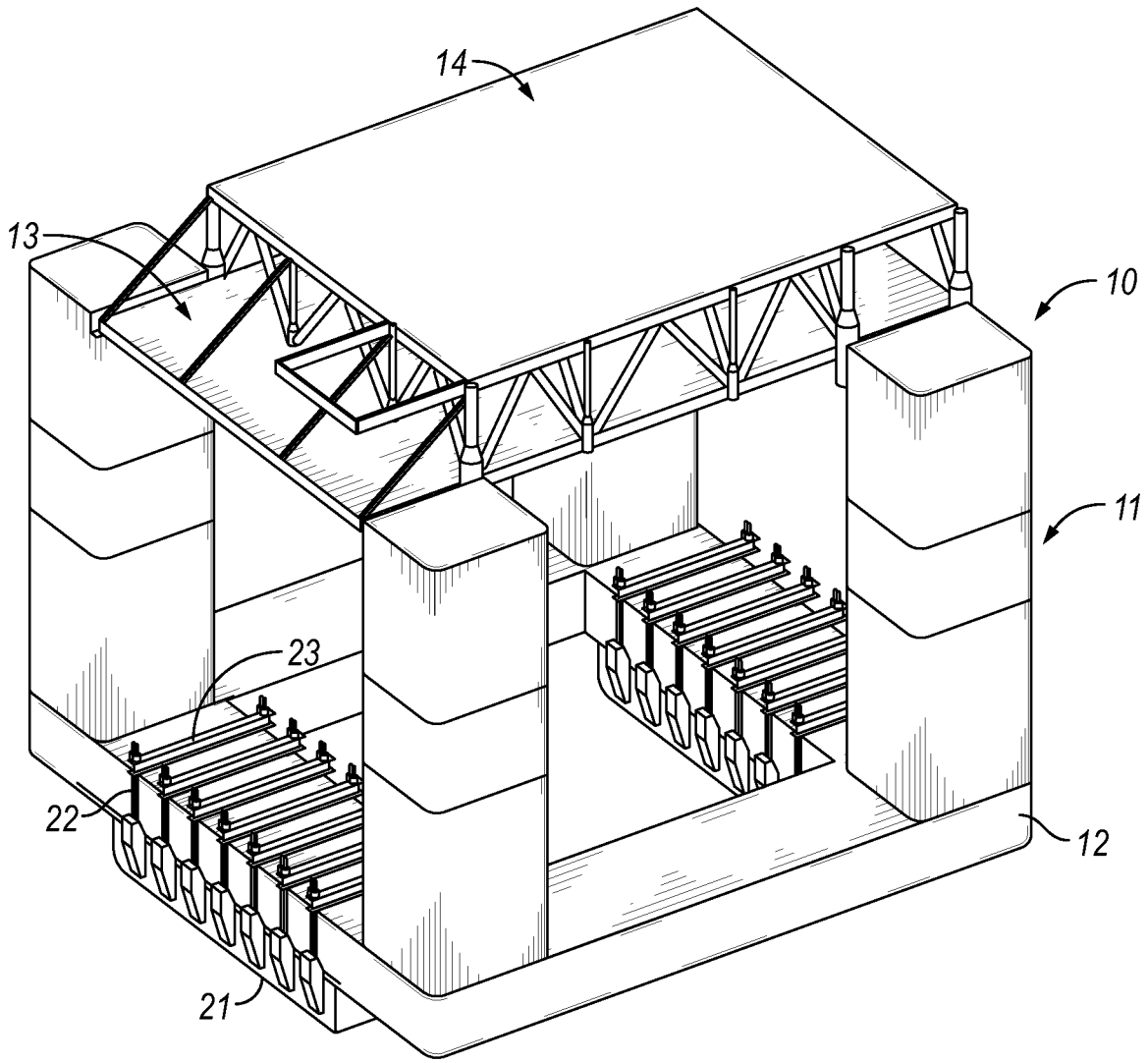
Figure 3:
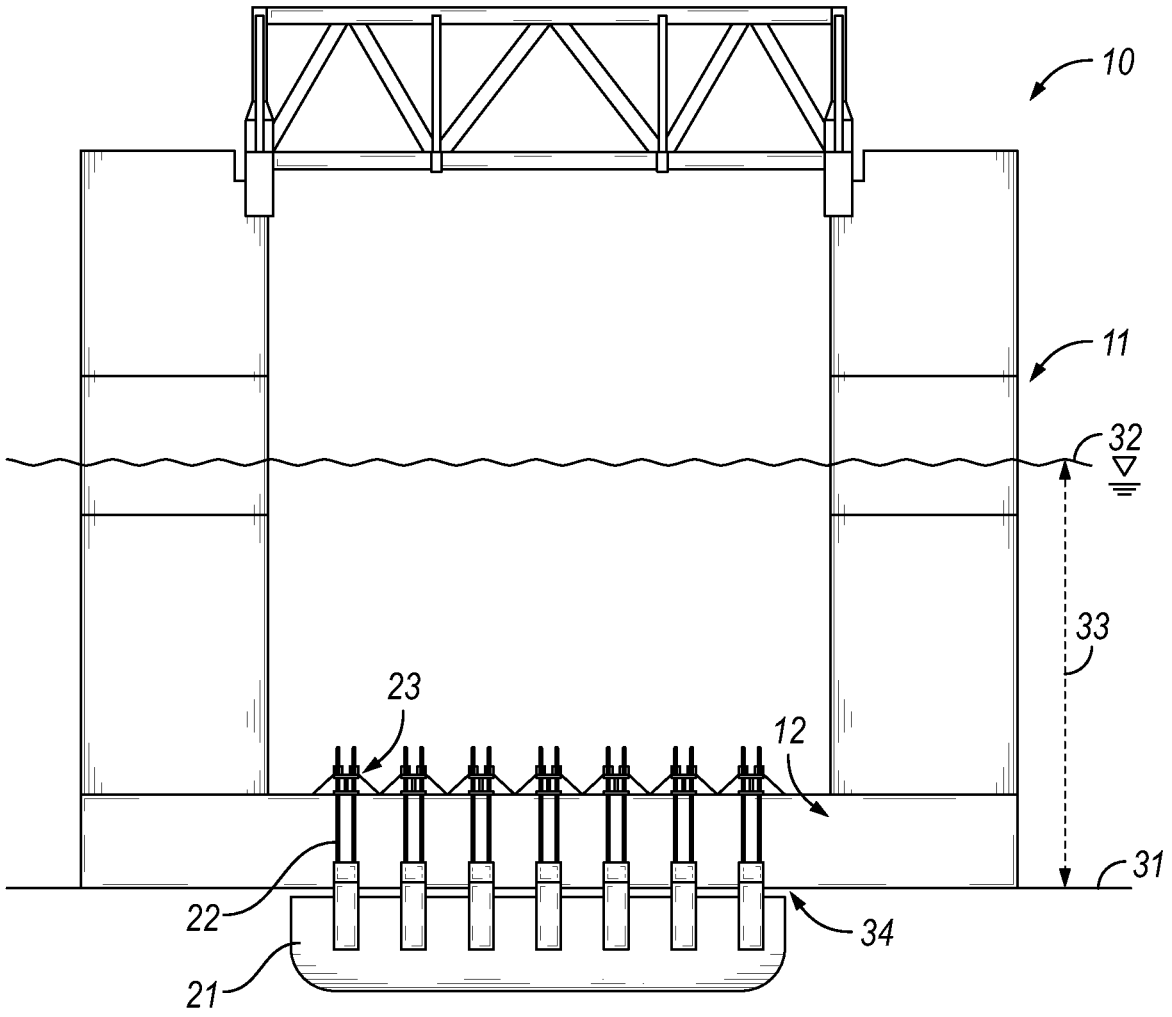
FIG. 3 and FIG. 4 are elevation views of the semi-submersible structure of FIGS. 1 and 2.
Figure 4:
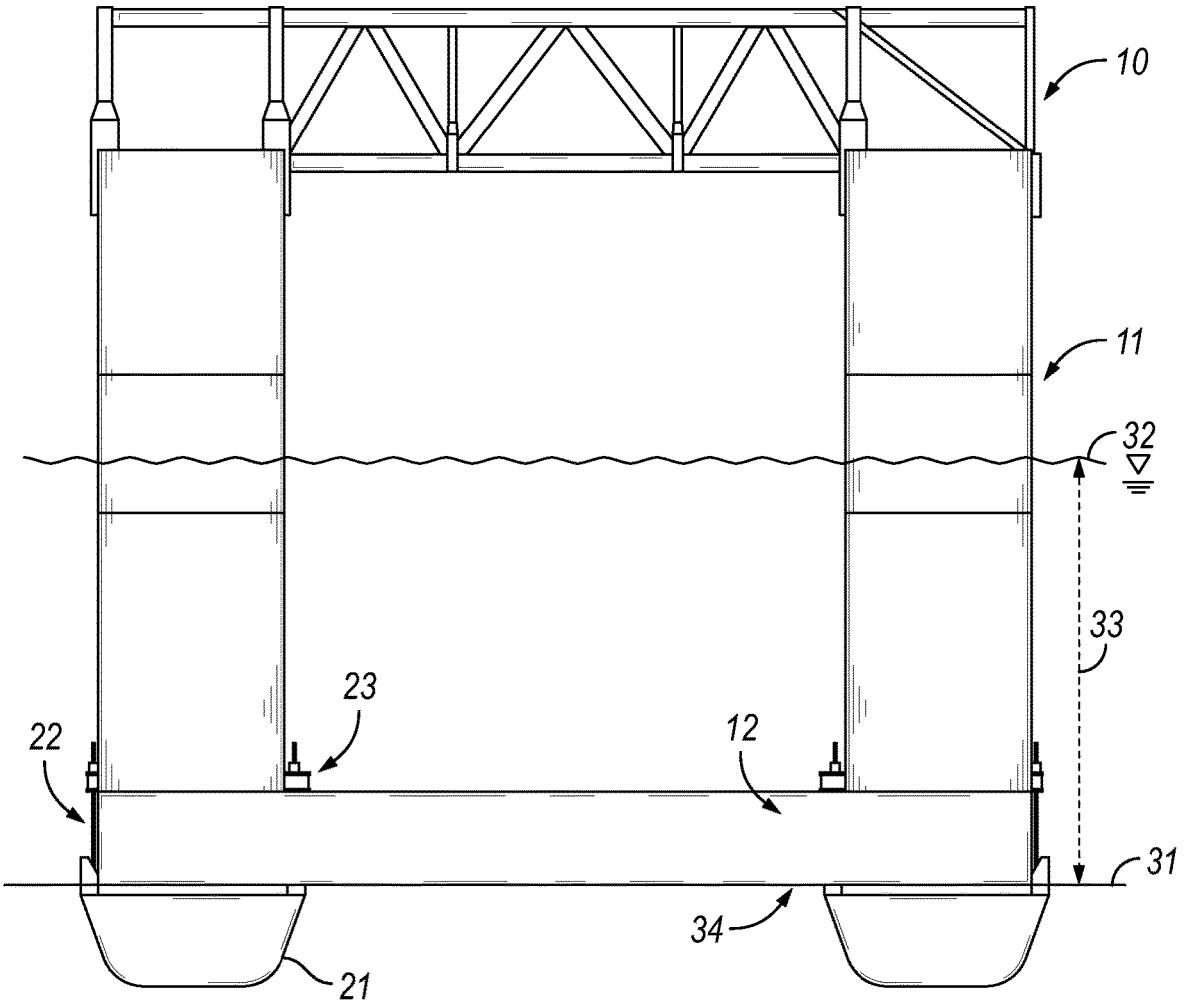

FIGS. 1-4 depict different views of an example semi-submersible floating structure 10 that incorporates one or more under keel tanks in accordance with an embodiment of this disclosure. In particular, FIG. 1 is an underside perspective view, FIG. 2 is an overhead perspective view, and FIGS. 3 and 4 are elevation views. The illustrated semi-submersible floating structure 10 includes columns 11 extending between one or more pontoons 12 and a deck level (e.g., production deck 13 or main deck 14) where process equipment is generally located. In its configuration, the columns 11 extend vertically upward (generally aligned with Earth gravity) from a pontoon (or pontoons) 12. As non-limiting examples, there may be two pontoons 12 if the structure 10 is a drilling semi-submersible, or four pontoons in a ring shape if the structure 10 is a production platform.

In a typical configuration, the columns 11 and pontoons 12 are subdivided into voids and watertight compartments (ballast tanks), and the ballast tanks are often filled with ballast water to maintain stability of the structure 10. A portion of the pontoon ballast may be removed to maintain operating draft, for instance when additional topsides equipment and/or risers and umbilicals are installed. The topsides equipment is installed typically at the deck level and its payload has much higher vertical center of gravity than the ballast water compensated, resulting in the platform having overall reduced metacentric height and stability.

As shown in FIGS. 1-4, the semi-submersible floating structure 10 has enhanced stability and payload capacity provided by at least one under keel tank 21 (shown as first and second under keel tanks 21). The first and second under keel tanks 21 are located at an elevation below the pontoon 12 and the keel 31 of the structure 10. The keel 31 is the bottom-most structural element of the hull. That is, in the illustrated embodiment, the under keel tanks 21 are located entirely below the pontoon 12. As shown in FIGS. 3 and 4, the draft 33 of the structure 10 is the vertical distance between the keel 31 and the waterline 32, and in certain embodiments the draft 33 may be dependent on several factors. For instance, the draft 33 is maintained as without the under keel tanks 21, or may be increased or decreased depending on the design.

In certain embodiments, the geometry of the under keel tanks 21 is determined by targeted platform capacity gain and/or targeted stability enhancement, and may be related to the size of the pontoons 12 of the structure 10. One example target is to maintain or improve the global performance of the structure 10 (e.g., platform payload capacity, stability, and motion). By way of non-limiting example, the under keel tank 21 to pontoon 12 volume ratio may be between 0.25 to 1. By way of another non-limiting example, the under keel tank 21 to pontoon 12 width ratio may be between 0.5 and 1.5, for example a ratio of 1.0 (i.e., equal width). The under keel tank 21 to pontoon 12 length ratio may be between 0.5 to 1.7, for example a ratio of about 1.0 (i.e., equal length). The length of the pontoon 12 may be considered the length between adjacent columns, with regard to the ratios described herein. The under keel tank 21 to pontoon 12 height ratio may be between 0.25 to 2.

In certain embodiments, the shape of the under keel tank 21 may be configured such that the under keel tank 21 is the same shape as the pontoon 12 on at least one side, for example to provide even buoyancy across at least a predetermined portion of an underside of the pontoon 12. While the under keel tank 21 may have any appropriate cross-sectional geometry, by way of non-limiting example, the shape of the under keel tank 21 may be flat on one side to complement the flat underside of the pontoon 12. The cross-sectional shape of the under keel tank 21 may be, for instance, rectangular or trapezoidal, with or without corner radius in one or two directions.

As noted, the manner in which the under keel tanks 21 are ballasted may directly affect the vertical center of gravity of the structure 10 and the draft 33. In accordance with this disclosure, the under keel tanks 21 may have a variety of ballast configurations. By way of non-limiting example, in one configuration, at least one under keel tank 21 is subdivided into compartments, wherein each compartment is capable of being individually ballasted separately from other compartments. In another configuration, at least one under keel tank 21 has one single compartment. These different configurations may be used separately, or in the same structure 10. That is, in certain embodiments, the structure 10 may incorporate an under keel tank 21 having separate compartments, and another under keel tank 21 having one single compartment. In other embodiments, the structure 10 may include only under keel tanks 21 with multiple separate compartments. In still further embodiments, the structure 10 may include only under keel tanks 21 having one single compartment.

The under keel tanks 21 may be ballasted with air, water (e.g., seawater), or solid materials for a fixed ballast (e.g., iron ore materials). In embodiments where a fixed ballast is used, the solid (fixed) ballast material density in seawater has a specific gravity of water greater than one (1) and has a flowability that is sufficient for offshore installation.

As shown in FIGS. 3 and 4, a gap 34 may be present between the under keel tanks 21 and the pontoons 12. The gap 34 is configured to allow space for components that may be present under the keel of the structure 10 such as anodes, sensor devices, or the like. The gap 34 may in certain situations also allow for manufacturing tolerances, structural deformations under load, and so forth. In certain embodiments, the gap between the under keel tank 21 and the pontoon 12 may be configured between 0 and 0.5 times pontoon height.

The under keel tanks 21 may be secured to the pontoons 12 both laterally and vertically using various types of structures, examples of which are shown in FIGS. 5-8. As shown for example in FIG. 5, such structures may include one or more vertical structures 22 vertically supporting each of the under keel tanks 21 relative to the pontoon 12 and connected to one or more support structures 23 on the pontoon 12. These structures may also include one or more lateral restraints 24 resisting movement (e.g., resisting lateral movement) of the under keel tank 21 relative to the pontoon 12. In one embodiment, the lateral restraints 24 may be sufficiently resistive to movement so as to prevent movement of the under keel tank 21 relative to the pontoon 12.

Figure 5:
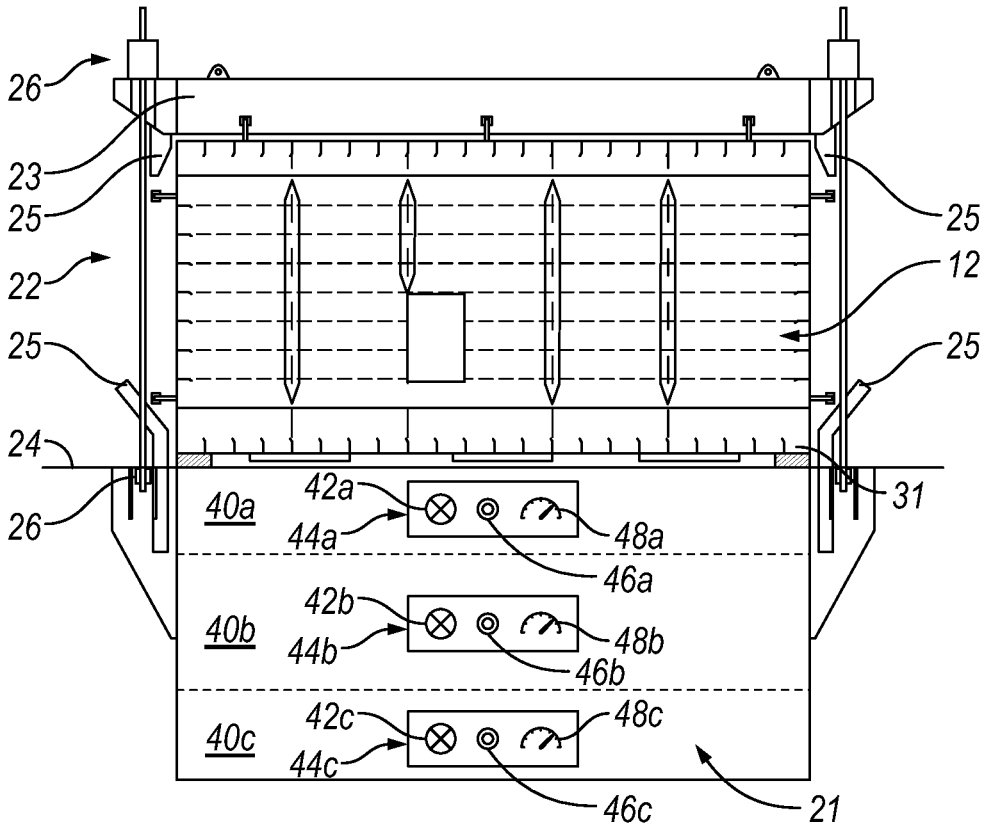
FIG. 5 is a cross-sectional elevation view of a pontoon and an under keel tank of a semi-submersible structure, connected with tendons, rods, or wires, according to an embodiment of the present disclosure.

More specifically, in the illustrated embodiment of FIG. 5, the one or more vertical structures 22 are tendons, rods, or wires that are connected to the support structure 23 on the pontoon 12. The tendons, rods, or wires are held in place by a locally or remotely operated lock/torque mechanism 26 positioned on the support structure 23 attached to or sitting on the pontoon 12. The lock/torque mechanism 26 may also be used to tension the tendons, rods, or wires.

The one or more lateral restraints 24, in the illustrated embodiment, include bearing pads (e.g., support/friction pads) positioned between the under keel tank 21 and the pontoon 12. The support/friction pads contact with the pontoon underside and the under keel tank 21 topside during installation of the under keel tank 21 onto the structure 10. When tensioned tendons, or rods, or wires are used as the vertical support 22, the support/friction pads (lateral restraints 24) regain and maintain contact to resist lateral movement and loading.

The illustrated configuration of FIG. 5 also includes installation guides 25 positioned on the support structure 23, and which may serve as stopper brackets. As discussed in further detail herein, the installation guides 25 may facilitate proper positioning of the under keel tanks 21 during installation. Other features of the under keel tank 21 and/or the pontoon 12 may also facilitate positioning during installation. Indeed, the installation guides 25 may be positioned on the under keel tank 21 as an alternative configuration, or in addition to being positioned on the support structure 23.

In accordance with certain embodiments, the under keel tank 21 may include a single compartment 40, or multiple compartments (40*a*, 40*b* and 40*c*) configured to be individually ballasted. Such a configuration may facilitate installation, as well as expansion of payload capacity and further stability enhancement. As shown in the embodiment of FIG. 5, the under keel tank 21 includes a first compartment 40*a*, a second compartment 40*b*, and a third compartment 40*c*, though the under keel tank 21 may include any number of compartments. Further, while the compartments 40 are shown as being vertically separated, the compartments 40 may be separated in any appropriate configuration, such as horizontally (e.g., side-by-side), diagonally, concentrically, and so forth. Each compartment 40 is configured to withstand pressures that may be experienced during installation and operation.

Each of the illustrated compartments 40 has a corresponding ballast control system 44, shown as 44*a*, 44*b*, and 44*c*. Together, the ballast control systems 44 include systems for adding and removing ballast, measuring, monitoring and controlling the conditions of the under keel tank 21, each compartment 40 being controlled by its corresponding ballast control system 44. The ballast control systems 44 may include closure devices 42 (or multiple closure devices 42*a*, 42*b* and 42*c*), which are capable of being remotely operated (e.g., using a remotely operated vehicle (ROV)) to allow filling of the corresponding compartment 40 with ballast material (e.g., water, air, solid) in an open configuration, and to seal the compartment 40 in a closed configuration. By way of non-limiting example, the closure devices 42 may include pull plugs, valves, or the like. In certain embodiments, the closure devices 42 may also include features that allow for transfer of ballast material between the compartments 40.

In certain embodiments, the ballast control systems 44 may include valves 46 (or multiple valves 46*a*, 46*b* and 46*c*) to allow the release of certain ballast materials (e.g., air) when appropriate. For example, one of the compartments 40 may be filled with ballast water, which may displace ballast air out of the compartment 40 via the corresponding valve 46 of the compartment 40.

To allow for monitoring of the ballast within each compartment 40 (or the overall under keel tank 21), the ballast control systems 44 may include corresponding measurement devices 48 (or multiple measurement devices 48*a*, 48*b* and 48*c*). Examples of such measurement devices 48 may include pressure gauges, floating gauges, or the like. The measurement devices 48 may be monitored using, for example, a camera installed on a ROV. Again, the ballast control systems 44 may be used during installation as well as throughout deployment.

Figure 6:
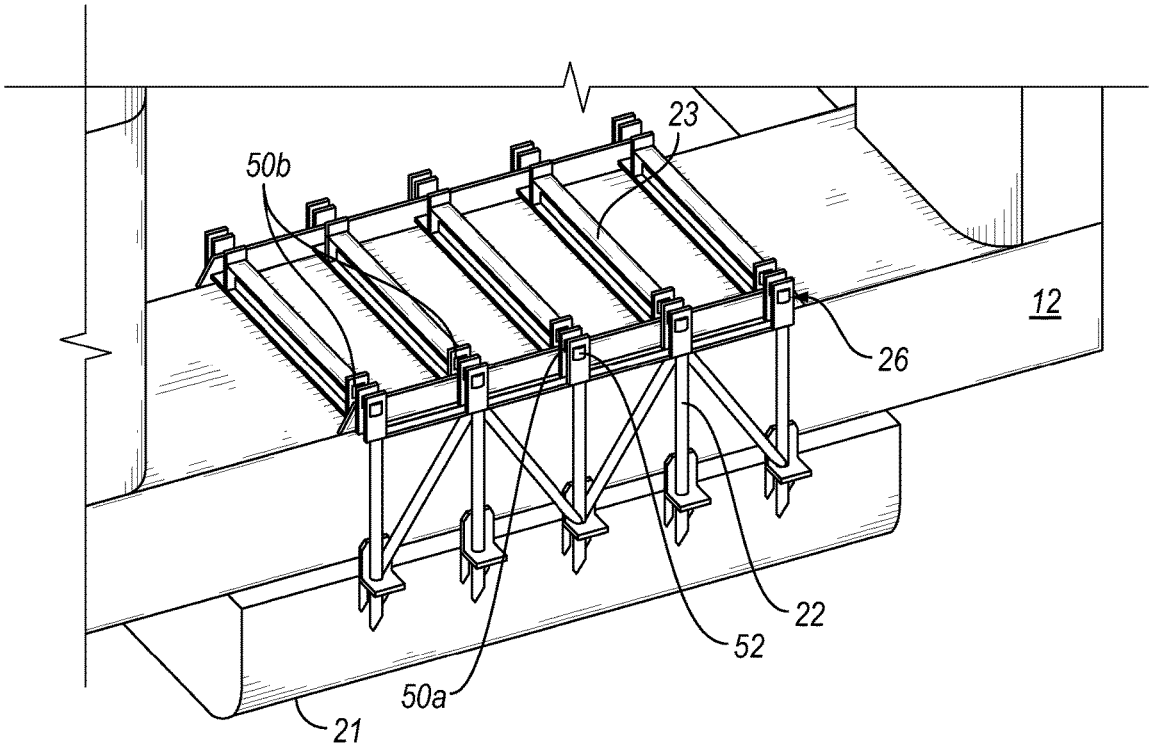
FIG. 6 is an expanded perspective view of a pontoon and an under keel tank of a semi-submersible structure, connected with a system of trusses, according to an embodiment of the present disclosure.
Figure 7:
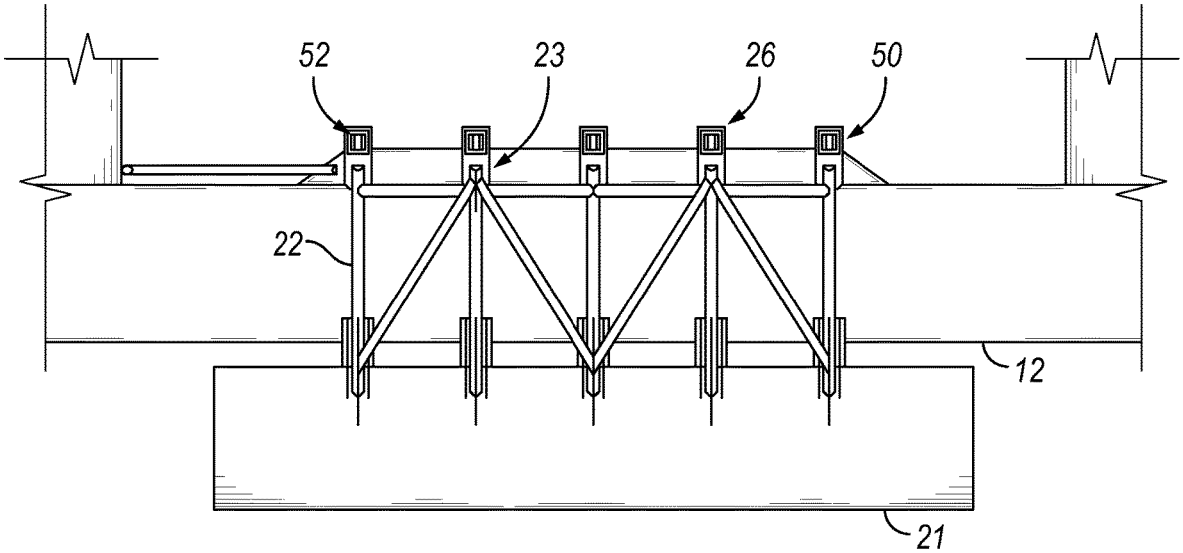
FIG. 7 is a cross-sectional elevation view of the structure of FIG. 6.

FIG. 6 is an expanded perspective view, and FIG. 7 is an elevation view of an example embodiment of how the under keel tanks 21 may be connected to the pontoons 12. In the illustrated embodiment, the under keel tank 21 includes a system of one or more truss structures as the vertical structure 22. The one or more truss structures may be preinstalled onto the under keel tank 21 before the under keel tank 21 is positioned for attachment to the pontoon 12. In certain embodiments, the one or more truss structures may also resist lateral movement of the under keel tank 21 relative to the pontoon 12. As illustrated, the system of one or more truss structures includes vertical components, horizontal components and diagonal components.

The one or more truss structures are illustrated as being attached to the support structure 23 of the pontoon 12. The lock/torque mechanism 26 employed in this embodiment is a locking pin arrangement. Other locking mechanisms may be used, as discussed below.

Figure 8:
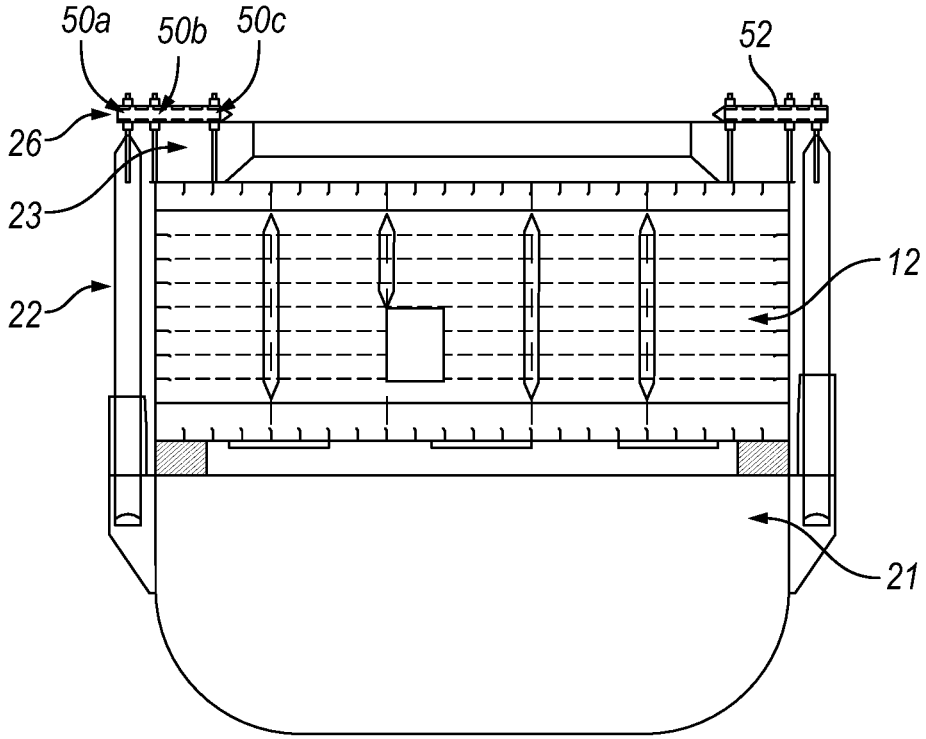
FIG. 8 is a cross-sectional elevation view of an embodiment of a pontoon and an under keel tank, connected with a system of trusses, according to an embodiment of the present disclosure.

Such a locking pin arrangement may include receptacles 50 (e.g., padeyes, rings) and pins 52, which can be more clearly seen in the side cross-sectional view of FIG. 8. Together, the support structure 23, the system of one or more truss structures, and the locking pin arrangement form an integrated system connecting the under keel tank 21 to the pontoon 12. In particular, the one or more truss structures include receptacles 50*a* that align with receptacles 50*b* of the support structure 23. Locking pins 52 are threaded through the receptacles 50 to retain the positioning of the under keel tank 21 relative to the pontoon 12.

Figure 9:
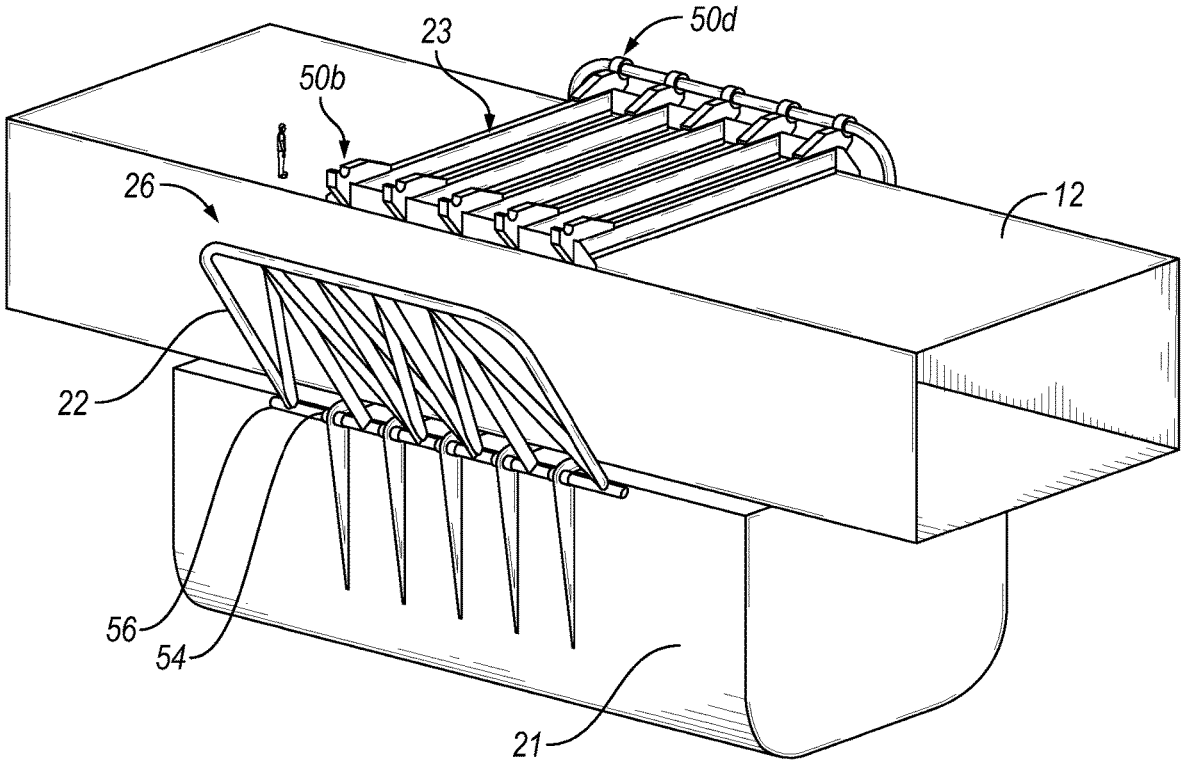
FIG. 9 is a perspective view of a pontoon and an under keel tank of a semi-submersible structure, connected with a pivoting system of trusses, according to an embodiment of the present disclosure.

FIG. 9 is a perspective view of an embodiment of the locking mechanism 26 in which the system of trusses (vertical support 22) is attached to the under keel tank 21 via one or more receptacle connections 50*b*. In particular, in the illustrated embodiment the system of moveable trusses 22 is pivoted via a rod 56 that is rotatably secured to the under keel tank 21 by way of a pivoting feature 54. The pivoting feature (e.g., a sleeve) 54 is illustrated as a receptacle attached to the under keel tank 21, but other pivoting arrangements may be used. The one or more truss structures are illustrated in FIG. 9 as being pre-installed to the under keel tank 21 in a transportation mode in a folded position, and pulled up by pivoting to lock into the receptacle connections 50*b* of the support structure 23 of the pontoon 12. Once the truss 22 is lowered into the receptacle connections 50*b*, it is locked in position with covers 50*d*. The pivoting truss system in this embodiment eliminates the locking pins and operations, demonstrating that the under keel tank 21 can be secured to the pontoon 12 in a variety of ways.

Figure 10:
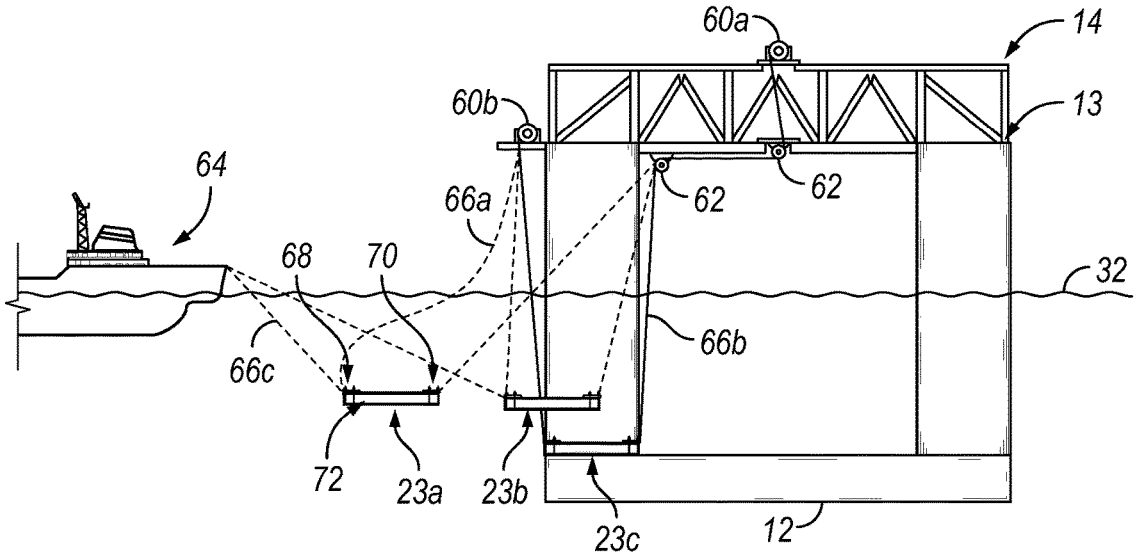
FIG. 10 is an elevation view of an example arrangement to install a support structure on the top of the pontoon for supporting the under keel tank on a semi-submersible structure, according to an embodiment of the present disclosure.

As set forth above, the present embodiments relate to installation of the under keel tanks 21 onto semi-submersible structures to enhance their payload capacity and stability. In this respect, certain aspects of this disclosure relate to processes and associated configurations used to install the under keel tanks 21 below one or more pontoons 12. FIG. 10 is an illustration of the manner in which the support structure 23 may be positioned on the pontoon 12, according to an embodiment. As shown in FIG. 10, the support structure 23 may be connected to a series of platform winches 60 (60*a*, 60*b*), platform pulleys 62, and a winch on a transport ship 64 to facilitate the installation.

The illustrated configuration depicts the support structure 23 in a series of three positions, denoted as support structure 23*a*, support structure 23*b*, and support structure 23*c*. Line 66*a* (e.g., a winch wire) maintains connection between the support structure 23 and an outwardly positioned platform winch 60*b* to stabilize an outward side 68 of the support structure 23 once the support structure 23 is sufficiently close to the structure 10. Line 66*b* (e.g., another winch wire) maintains connection between the support structure 23 and a topside platform winch 60*a* via pulleys 62 to stabilize an inward side 70 of the support structure 23. Line 66*c* (e.g., a third winch wire) connects the support structure 23 to the winch of the transport ship 64.

During installation, the support structure 23 is moved toward and above the pontoon 12 by appropriate activation of the winches 60*a*, 60*b*, 64. Guide brackets below the support structure 23 may assist with positioning of the support structure 23 on the pontoon 12.

As may be appreciated from FIG. 10, the installation of the support structure 23 may be performed below the water line 32. The support structure 23 may have built-in buoyancy chambers 72 to assist with underwater stabilization, mobility, and handling of the support structure 23. The support structure 23 may be filled with a fixed ballast material, ballast water, or the like.

Figure 11:
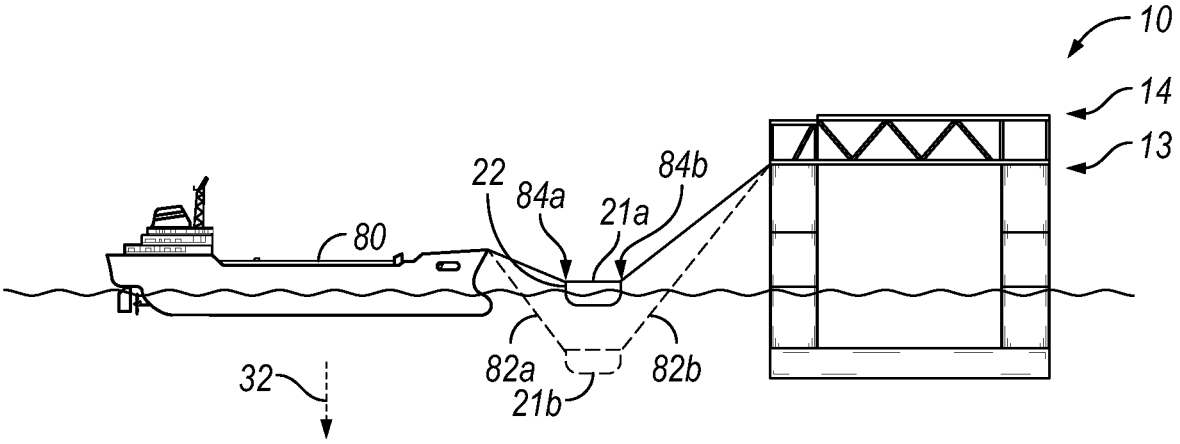
FIGS. 11-14 are perspective views of progressing stages of installation of an under keel tank on a semi-submersible structure, according to certain embodiments of the present disclosure.

FIGS. 11-15 depict an example embodiment of a process and associated configuration for installing one of the under keel tanks 21 under one of the pontoons 12. In FIG. 11, the under keel tank 21 is shown as being in a first position (illustrated as under keel tank 21*a*) and a second position (illustrated as under keel tank 21*b*). The illustrated under keel tank 21 is secured to the semi-submersible floating structure 10 and to an offshore vessel 80 via a series of lines 82 (82*a*, 82*b*). The lines 82 are secured to the under keel tank 21.

More specifically, in the illustrated embodiment the under keel tank 21 is secured to the offshore vessel 80 via a first set of lines 82*a* connected to a first side 84*a* of the under keel tank 21 and, for example, winches of the vessel 80. Similarly, the under keel tank 21 is secured to the semi-submersible floating structure 10 via a second set of lines 82*b* connected to a second side 84*b* of the under keel tank 21 and, for example, platform winches on the production deck 13 and/or main deck 14.

A first ballasting of the under keel tank 21, which may be performed for example onshore via solid ballast, places the under keel tank 21 in the first position (21*a*). By way of non-limiting example, solid ballast material may be added to a first compartment of the under keel tank 21 either onshore or offshore. Water ballast is then added (e.g., to a second compartment of the under keel tank 21) to allow for submergence completely below the water line 32 (21*b*). The under keel tank 21 is then lowered via the winches on the vessel 80 and the structure 10 to below the pontoon 12, as shown in FIG. 12.

Figure 12:
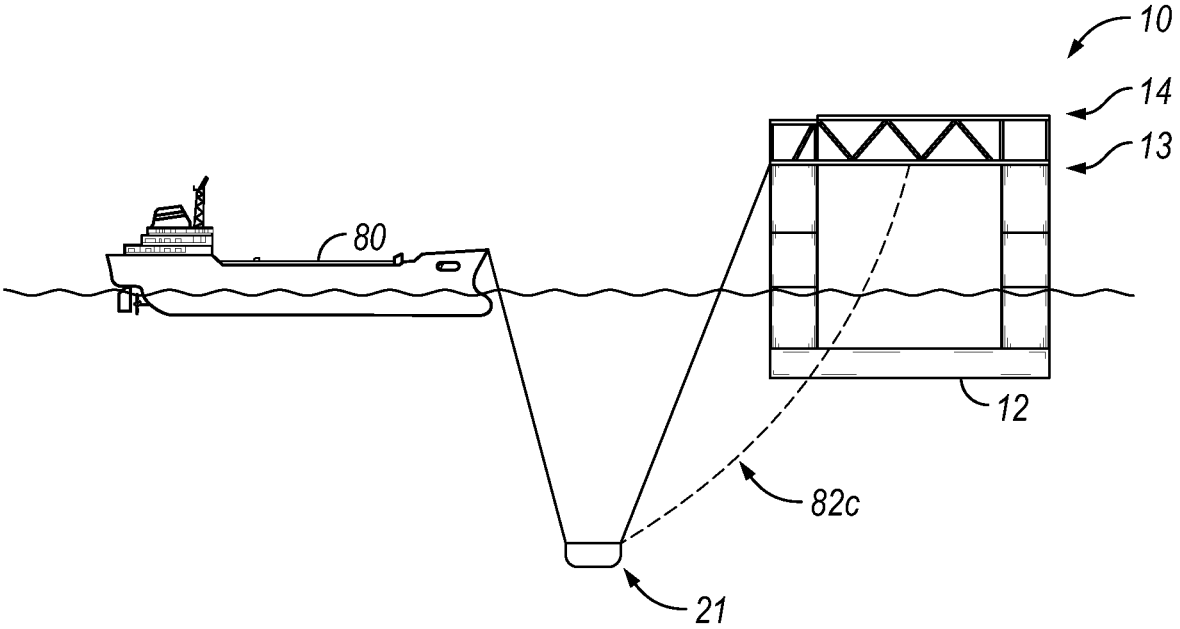

In FIG. 12, the under keel tank 21 is attached to another part of the structure 10, for example additional winches on the main deck 14 or the production deck 13, via a third set of lines 82*c*. The third set of lines 82*c* are used to bring the under keel tank 12 into position below the pontoon 12 with an underwater hand-shake.

Figure 13:
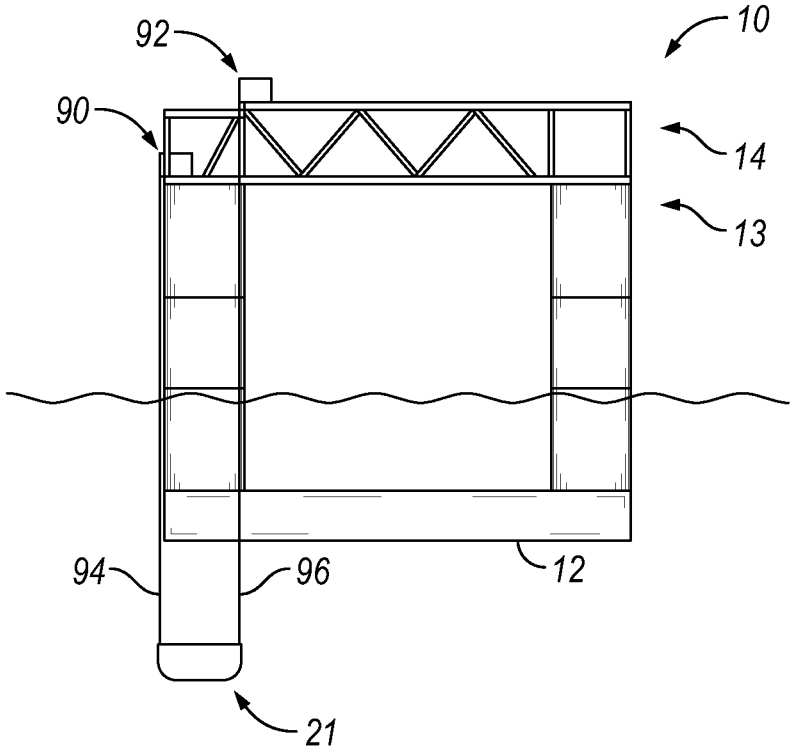
Figure 14:
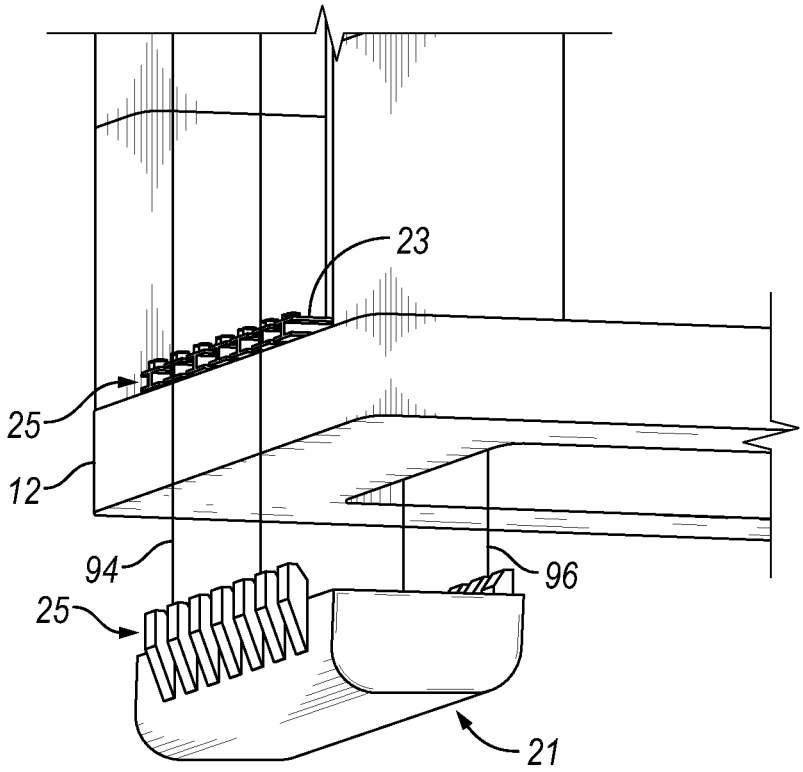

FIGS. 13 and 14 depict the configuration of the under keel tank 21 relative to the pontoon 12 once they are generally aligned. In FIG. 13, the structure 10 includes topsides winches (illustrated as production deck winches 90 and main deck winches 92) connected to first connection lines 94 and second connection lines 96, respectively.

As shown in the expanded view of FIG. 14, during the installation process, the connecting lines 94, 96 from the topsides winches are aligned with the pontoon 12, and the under keel tank 21 is raised to engage its installation guides 25 with the underside of the pontoon 12. More specifically, the under keel tank 21 is brought into position by the installation guides 25 (also acting as lateral restraints after installation). Compressed air, or the like, is then added to raise the under keel tank 21 to a secure position.

In embodiments where the under keel tank 21 includes pre-installed truss structures, the pins on top of the support structure 23 will be engaged with the tank truss structures with the help of hydraulic jacks and physically connect the tank to the support structure 23. In embodiments utilizing pivoting trusses 22, the trusses will be pulled up and lowed into the support structure 23 with the help of hydraulic jacks. In embodiments utilizing tendons, the tendons will be installed locally by ROV and/or using divers.

Figure 15:
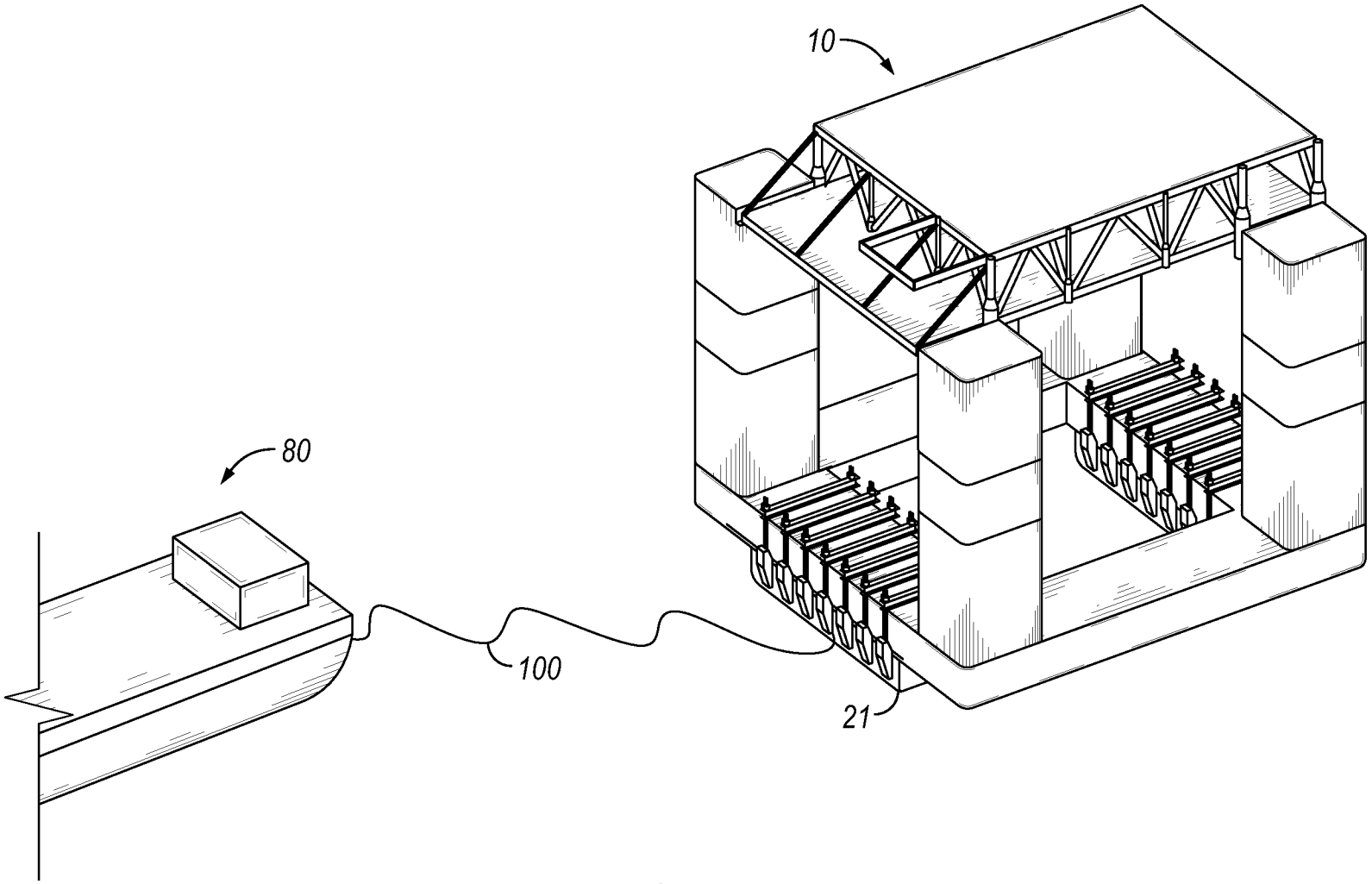
FIG. 15 is a perspective view of an example arrangement to provide ballast material to the under keel tank already attached in-place to the semi-submersible structure, according to an embodiment of the present disclosure.

In some embodiments, the under keel tanks 21 of the present disclosure may be configured to be ballasted at different stages over the life of the structure 10. FIG. 15 is a perspective view of an example arrangement to install additional solid (fixed) ballast material to the under keel tank 21 already attached in-place to the semi-submersible floating structure 10. Such additional solid (fixed ballast material) would provide for even larger topsides capacity gain and/or additional stabilization according to the embodiments of the present disclosure. In the illustrated embodiment, a flowline 100 capable of carrying the solid ballast material connects the vessel 80 and the under keel tank 21 to allow for filling of the under keel tank 21 with a predetermined amount of ballast material.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

What is claimed is:

1. A semi-submersible floating structure for offshore energy development, the semi-submersible floating structure comprising:

a pontoon;

a column or a plurality of columns extending from the pontoon to a deck;

an under keel tank or a plurality of under keel tanks secured under the pontoon, and filled with air, water, or solid material, or any combination thereof, as ballast;

one or more vertical structures vertically supporting the under keel tank relative to the pontoon and connected to one or more support structures on the pontoon;

one or more lateral restraints resisting lateral movement of the under keel tank relative to the pontoon; and a system of truss structures connecting the under keel tank to a support structure on the top of the pontoon, through a locking mechanism, forming an integrated system, wherein the system of truss structures corresponds to the one or more vertical structures, and the support structure corresponds to the one or more support structures.

2. The structure of claim 1, wherein the under keel tank is subdivided into compartments, wherein each compartment is capable of being individually ballasted separately from other compartments.

3. The structure of claim 1, wherein the under keel tank is a single compartment.

4. The structure of claim 1, wherein the under keel tank is secured to the pontoon without welds.

5. The structure of claim 1, wherein the one or more vertical structures are connected mechanically or are welded to the support structure located on the top of the pontoon.

6. The structure of claim 1, wherein the one or more lateral restraints comprises a support structure, a friction pad, a stopper bracket, or any combination thereof.

7. The structure of claim 1, wherein the tank comprises a closure device capable of being remotely operated to enable flooding of the under keel tank with ballast water in an open configuration, and to seal the under keel tank in a closed configuration.

8. A method of increasing payload capacity and/or stability of a floating structure for offshore energy development comprising:

securing an under keel tank under a keel of the floating structure;

wherein the under keel tank is filled with air, water, or solid material, or any combination thereof, as ballast;

wherein the ballast of the under keel tank supplements or replaces a ballast of the floating structure, thereby lowering the vertical center of gravity of the floating structure and increasing the payload capacity and/or stability of the floating structure; and wherein a system of truss structures is pre-installed or post-installed, fixed or pivoting, to connect the under keel tank to a support structure on the top of a pontoon of the floating structure, through receptacles and pins, forming an integrated system.

9. The method of claim 8, wherein securing the under keel tank under the keel comprises:

vertically supporting the under keel tank relative to a pontoon of the floating structure using the system of truss structures connected to the support structure on top of the pontoon; and restraining lateral movement of the under keel tank relative to the pontoon using one or more lateral restraints positioned against the pontoon and under keel tank.

10. The method of claim 8, wherein the under keel tank is partially or fully pre-installed with ballast material at a fabrication yard, loaded out, or floated out in a buoyant condition.

11. The method of claim 8, wherein the under keel tank is installed at an offshore site.

12. The method of claim 11, wherein the under keel tank is flooded for lowering below the waterline and at an elevation below a pontoon of the floating structure, with winches and connecting lines used for positioning the under keel tank under the pontoon.

13. The method of claim 12, wherein after the under keel tank is positioned under a pontoon of the floating structure, the under keel tank is de-ballasted to become buoyant and to float up, and is positioned with tank-mounted installation guides to the underside of the pontoon.

14. The method of claim 8, wherein the under keel tank and ballast therein are;

installed on an existing facility using a remotely operated vehicle, or installed on a newly built floating structure.

15. The method of claim 8, wherein the under keel tank is opened to sea by remotely opening a closure device to thereby become a flooded soft tank, or remains watertight as a sealed ballast tank.

16. The method of claim 8, wherein additional solid ballast material is introduced into the under keel tank to gain larger topsides payload capacity or increase stability and motion performance of the floating structure.

17. The method of claim 8, wherein the floating structure is a tension leg platform (TLP), a floating wind turbine platform, or a mobile offshore drilling unit.

18. An under keel tank configured to be installed under the keel of a floating structure for offshore energy development, comprising:

one or more compartments capable of being ballasted so as to allow the under keel tank to have sufficient ballast to expand a payload capacity of the floating structure, or to provide additional stability for the floating structure; and one or more structures attached to the one or more compartments configured to allow the tank to be secured under the keel of the floating structure, wherein the one or more structures comprise a system of truss structures configured to connect the one or more compartments to a support structure on top of a pontoon of the floating structure, through a locking mechanism, forming an integrated system.

19. The under keel tank of claim 18, having a geometry configured to be installed under a pontoon of the floating structure, wherein:

the under keel tank to pontoon volume ratio is between 0.25 to 1;

the under keel tank to pontoon width ratio is between 0.5 and 1.5;

the under keel tank to pontoon length ratio is between 0.5 to 1.7; and the under keel tank to pontoon height ratio is between 0.25 to 2.

20. The under keel tank of claim 18, comprising a ballast control system configured to control ballasting of at least one of the one or more compartments.

* * * * *